US006592316B2

(12) United States Patent
Hensler

(10) Patent No.: US 6,592,316 B2
(45) Date of Patent: Jul. 15, 2003

(54) AUTOMATIC POLE GUIDE TRANSFER MECHANISM

(75) Inventor: David L. Hensler, Leesburg, IN (US)

(73) Assignee: Hydra Tech, Inc., Fort Wayne, IN (US)

( * ) Notice: Subject to any disclaimer, the term of this patent is extended or adjusted under 35 U.S.C. 154(b) by 35 days.

(21) Appl. No.: 09/851,749

(22) Filed: May 9, 2001

(65) Prior Publication Data

US 2002/0119030 A1 Aug. 29, 2002

Related U.S. Application Data

(60) Provisional application No. 60/272,024, filed on Feb. 28, 2001.

(51) Int. Cl.[7] ..... B66C 1/62
(52) U.S. Cl. ..... 414/23; 212/292
(58) Field of Search ..... 414/23; 212/231, 212/292

(56) References Cited

U.S. PATENT DOCUMENTS 3,631,991 A * 1/1972 Wacht et al. ..... 414/23
3,819,063 A * 6/1974 Reimbold, Jr. ..... 414/23

* cited by examiner

*Primary Examiner*—Janice L. Krizek
(74) *Attorney, Agent, or Firm*—Baker & Daniels

(57) ABSTRACT

A digger derrick truck for installing poles into the ground. The digger derrick truck includes a boom on which a pole guide assembly is slidably mounted. The pole guide assembly is operatively associated with a latching mechanism which releasably couples the pole guide assembly and the boom in an operative position and an inoperative position. The latching mechanism includes a latch arm and a release mechanism such that, when the boom is retracted, the release mechanism allows the latch arm to pivot and couple the pole guide assembly and the boom.

21 Claims, 6 Drawing Sheets

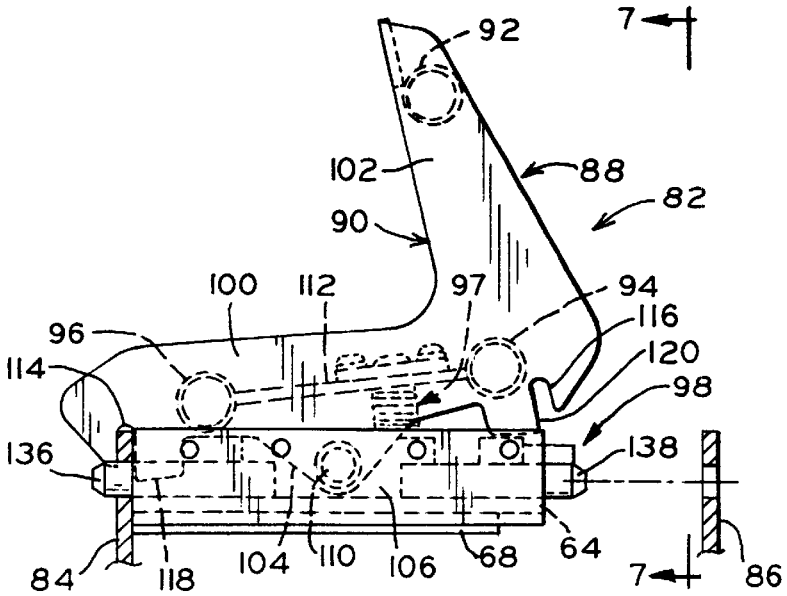
FIG_6
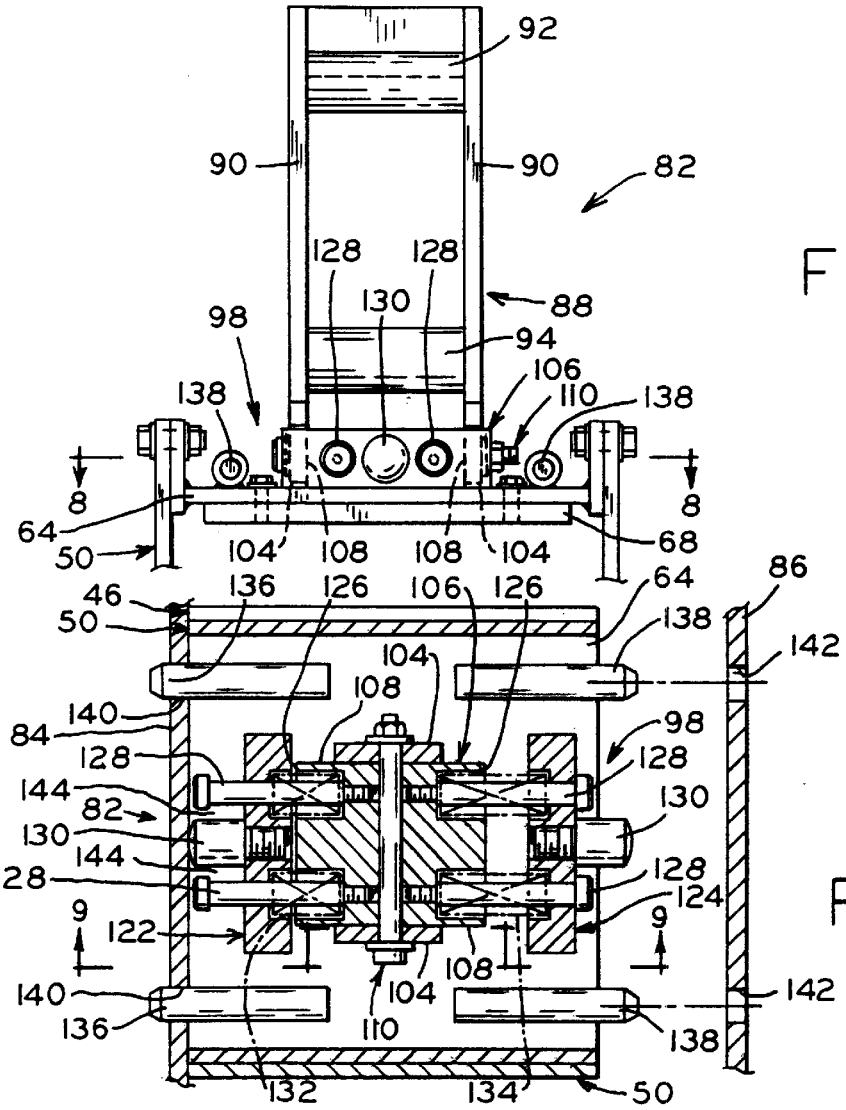
FIG_7
FIG_8

AUTOMATIC POLE GUIDE TRANSFER MECHANISM

This application claims the benefit of Provisional application Ser. No. 60/272,024, filed Feb. 28, 2001.

BACKGROUND OF THE INVENTION

The present invention relates to digger derrick trucks used for installing telephone poles.

Conventionally, digger derrick trucks have the capability of being used to maneuver telephone poles and to act as a crane. Digger derrick trucks include an auger for drilling a hole into which the telephone pole is placed. A boom is secured to the upper portion of the truck and has a pole guide assembly slidably mounted thereon for grasping and stabilizing the pole while it is being installed into the ground. The boom includes three telescoping boom sections which are extendable and retractable relative to one another. The pole guide assembly is attached to the end of the outermost boom section in an operative position. In this position the pole guide assembly may be used to grasp and maneuver the telephone pole. In addition to the pole guide assembly, a rope may be attached to a crane assembly secured to the end of the boom and wrapped around the pole to help stabilize the pole as it is being moved. The digger derrick may also be used solely as a crane by moving the pole guide assembly along the outermost boom section and attaching it in an inoperative position to the middle boom.

Conventionally, the pole guide assembly is secured to the boom sections by a single pin. The pin extends through aligning apertures in both the pole guide assembly and the boom section to lock the position of the pole guide assembly. In order to reposition such conventional pole guide assemblies, the boom must be lowered to the ground and the pin must be manually removed. The pole guide assembly is then moved into the operative or inoperative position and the apertures in the pole guide assembly and the boom section are aligned. The pin is thereafter manually replaced to secure the pole guide assembly in the selected position on the respective boom section.

A problem with this method of moving such pole guide assemblies between an operative and inoperative position is that it is laborious. The pole guide assembly is heavy and difficult to move. The apertures in the pole guide assembly and boom sections sometimes fail to line up properly making insertion of the pin in the misaligned apertures difficult. A hammer, or any other tool which is available, must be used to force the pin into the apertures. Further, in cold or in element weather, removing and replacing the pin is even more difficult due to difficult environmental conditions.

It is desired to provide a method and apparatus for easily moving the pole guide assembly of a digger derrick truck between an operative and inoperative position.

SUMMARY OF THE INVENTION

The present invention provides an improved method and apparatus for moving the pole guide assembly of a digger derrick truck between an operative and inoperative position.

Digger derrick trucks include a boom on which a pole guide assembly is slidably mounted. The pole guide assembly is provided with a latching mechanism including a latch arm and a release mechanism. The release mechanism is actuated when the boom sections are retracted and allows pivoting of the latch arm. The latch arm moves between a first and second position to releasably couple the pole guide assembly and the boom in an operative and inoperative position.

The present invention provides a digger derrick truck for installing poles into the ground. The digger derrick truck includes a boom mounted thereon and a pole guide assembly slidably mounted on the boom. The pole guide assembly is operatively associated with a latching mechanism which has a first position in which the latch mechanism releasably couples the pole guide assembly and the boom in an operative position. The latch mechanism also has a second position in which the latch mechanism releasably couples the pole guide assembly and the boom in an inoperative position.

The present invention provides a digger derrick truck for installing poles in the ground. The digger derrick truck includes a boom mounted thereon and a pole guide assembly slidably mounted on the boom. The pole guide assembly has an operative position and an inoperative position. A latching mechanism includes a release mechanism mounted on the frame of the pole guide assembly and a latch arm operatively associated with the release mechanism. The latch arm has a first position releasably coupling the pole guide assembly and the boom in the operative position and a second position releasably coupling the pole guide assembly and the boom in the inoperative position.

The present invention provides a method for moving a pole guide assembly of a digger derrick truck between an operative and an inoperative position. The first step includes mounting the pole guide assembly on a boom secured to the digger derrick truck. The boom has a plurality of telescoping boom sections. A latch mechanism having a latch arm is mounted on the pole guide assembly. The telescoping boom sections of the boom are retracted actuating a release mechanism which is operatively associated with the latch arm. The latch arm pivots to releasably couple the pole guide assembly and the boom. The telescoping boom sections are then extended.

An advantage of the present invention is that the latching mechanism allows the pole guide assembly mounted on the boom of the digger derrick truck to be moved between an operative and inoperative position without requiring manual labor.

A further advantage of the present invention is that the latching mechanism may not be prematurely released to inadvertently uncouple the pole guide assembly from the boom.

BRIEF DESCRIPTION OF THE DRAWINGS

The above mentioned and other features and objects of this invention, and the manner of attaining them, will become more apparent and the invention itself will be better understood by reference to the following description of the embodiment of the invention taken in conjunction with the accompanying drawings, wherein:

FIG. 6 is a side view of a latching mechanism in accordance with the present invention;

FIG. 7 is an end view of the latching mechanism of FIG. 6 taken along line 7—7;

FIG. 8 is a sectional view of the latching mechanism of FIG. 7 taken along the line 8—8;

Figure 2:
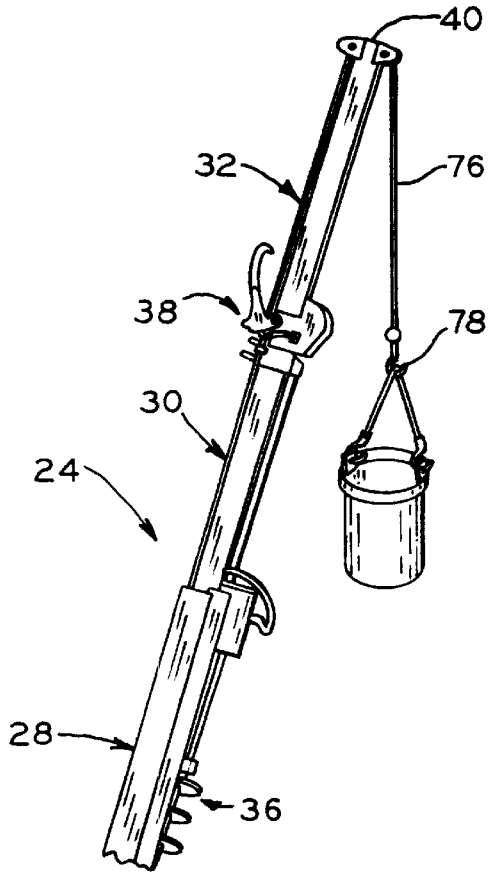
FIG. 2 is a fragmentary perspective view of the boom of the digger derrick truck of FIG. 1.

Corresponding reference characters indicate corresponding parts throughout the several views. Although the drawings represent an embodiment of the present invention, the drawings are not necessarily to scale and certain features may be exaggerated in order to better illustrate and explain the present invention.

DETAILED DESCRIPTION OF THE INVENTION

Figure 1:
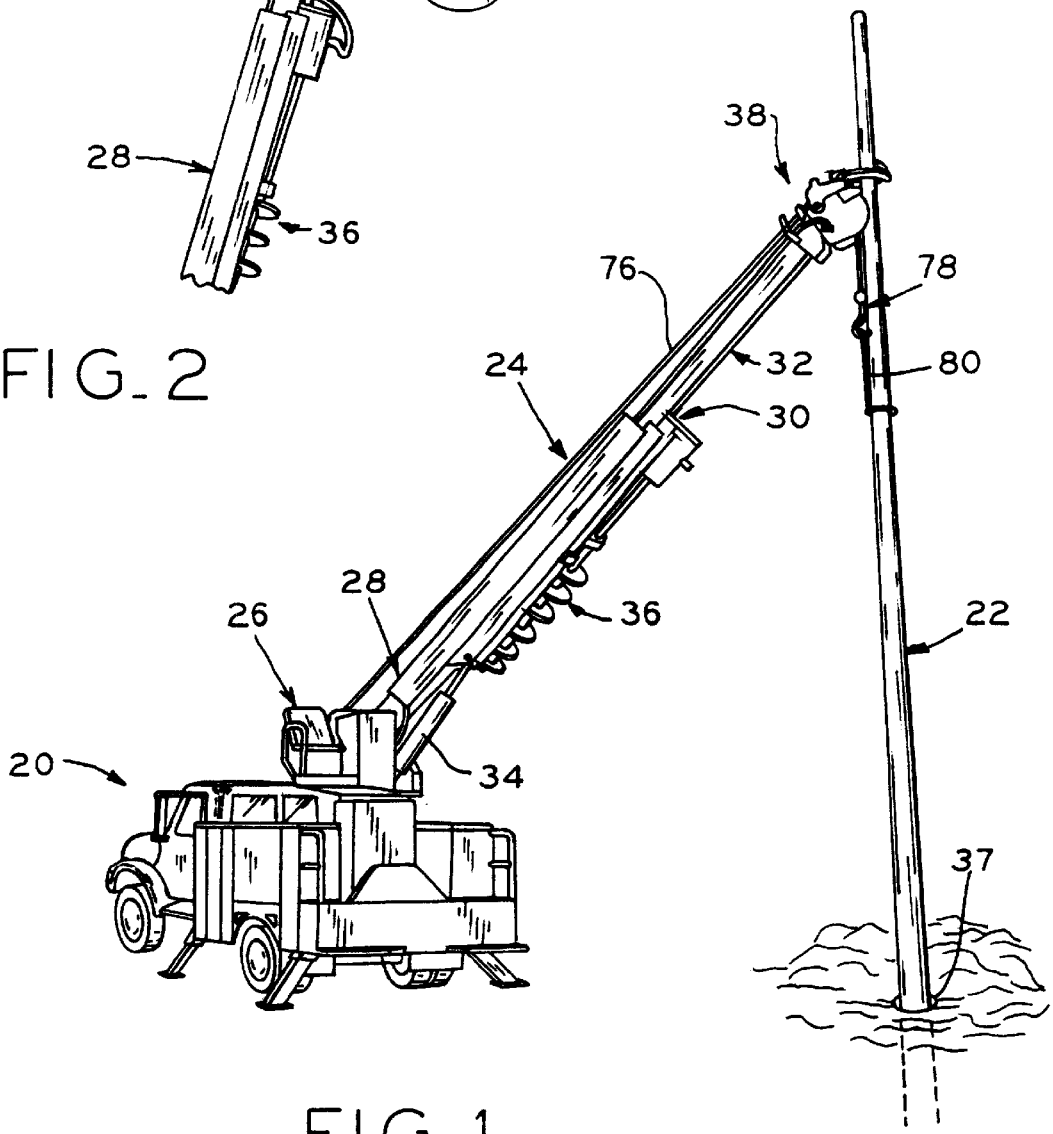
FIG. 1 is a perspective view of a digger derrick truck, in accordance with the present invention, while installing a telephone pole.

Referring to FIGS. 1 and 2, digger derrick truck 20 is used for installing metal telephone poles 22 into the ground. Digger derrick truck 20 includes hydraulically movable boom 24 mounted to control platform 26 located on the upper surface of digger derrick truck 20. Boom 24 includes three boom sections 28, 30, and 32 which are telescopically linked. Outer boom section 28 is mounted to control platform 26 and slidably receives middle boom section 30. Inner boom section 32 is slidably mounted within middle boom section 30. Boom sections 28, 30, and 32 are extended and retracted relative to one another by hydraulic cylinders (not shown). Hydraulic cylinder 34 is connected to both control platform 26 and boom section 28 to raise and lower boom 24. Auger 36 is pivotally attached to boom 24 and is hydraulically operated from control platform 26 to drill hole 37 into the ground. In its inoperative storage position, auger 36 lies adjacent boom 24.

Figure 12:
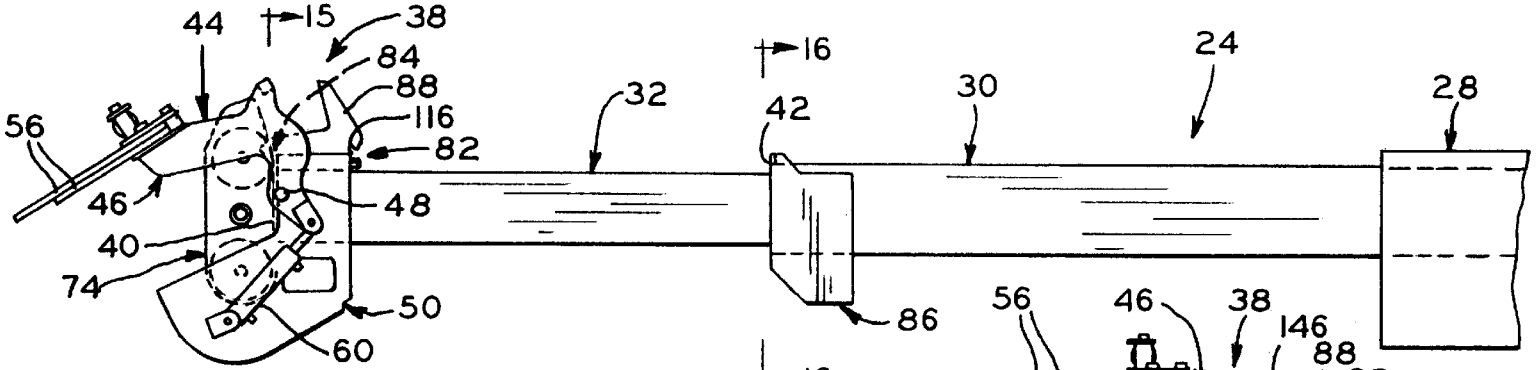
FIG. 12 is a side view of the boom with the pole guide assembly in an operative position.
Figure 14:
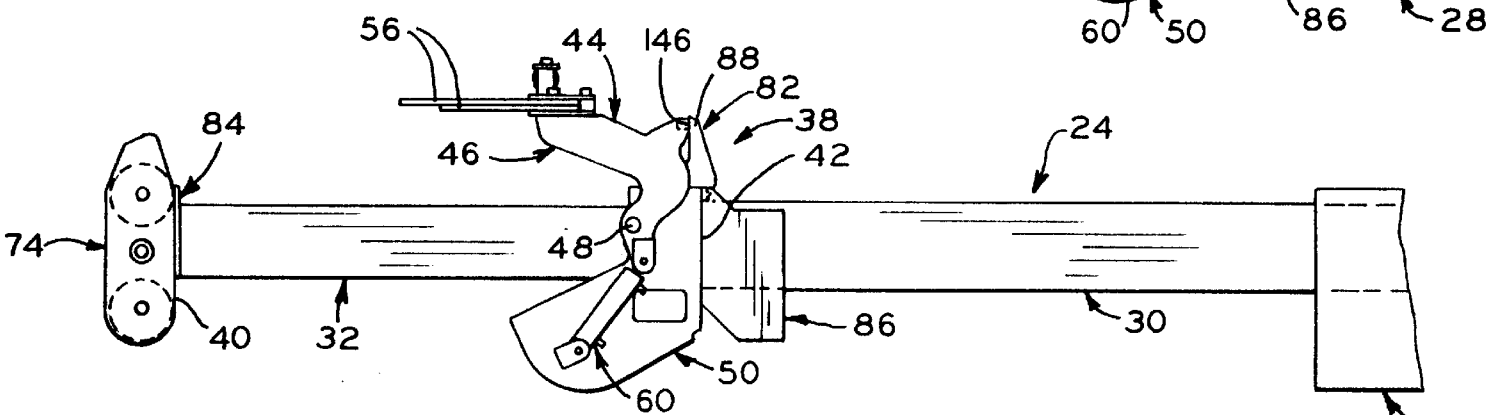
FIG. 14 is a side view of the boom with the pole guide assembly in an inoperative position.

Movably mounted on inner boom section 32 is pole guide assembly 38 (FIGS. 3, 4, and 5) which is used to grasp and stabilize telephone pole 22 during installation. Pole guide assembly 38 has an operative position in which it is releasably coupled to end 40 of inner boom 32 (FIGS. 1 and 12). In an inoperative position, pole guide assembly 38 is releasably coupled to end 42 of middle boom section 30 (FIGS. 2 and 14). The operation and movement of boom 24, auger 36, and pole guide assembly 38 is controlled by an operator at control platform 26.

Figure 3:
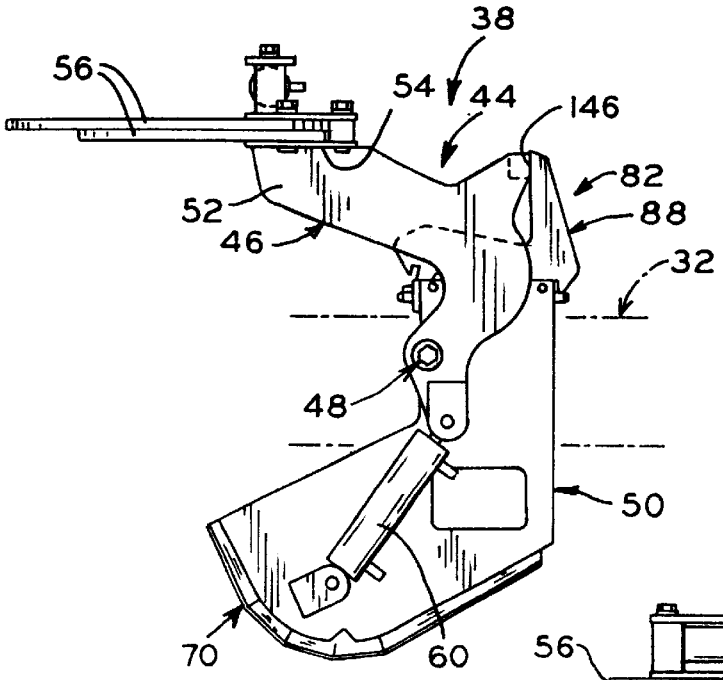
FIG. 3 is a side view of a pole guide assembly in accordance with the present invention.
Figure 4:
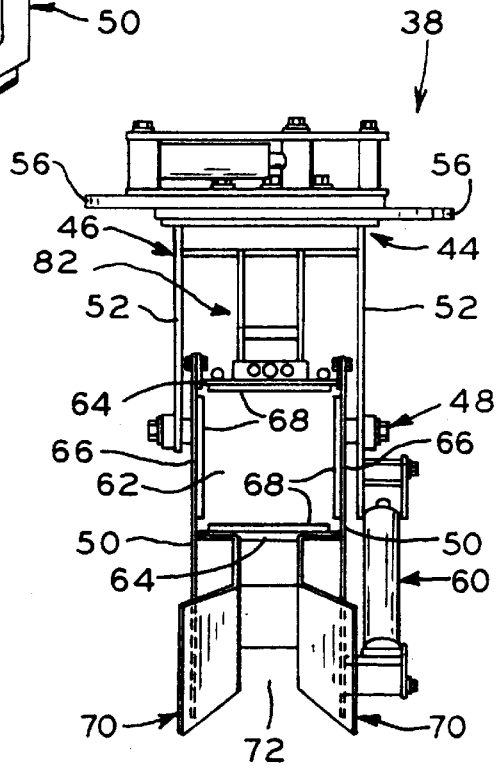
FIG. 4 is an end view of the pole guide assembly of FIG. 3.
Figure 5:
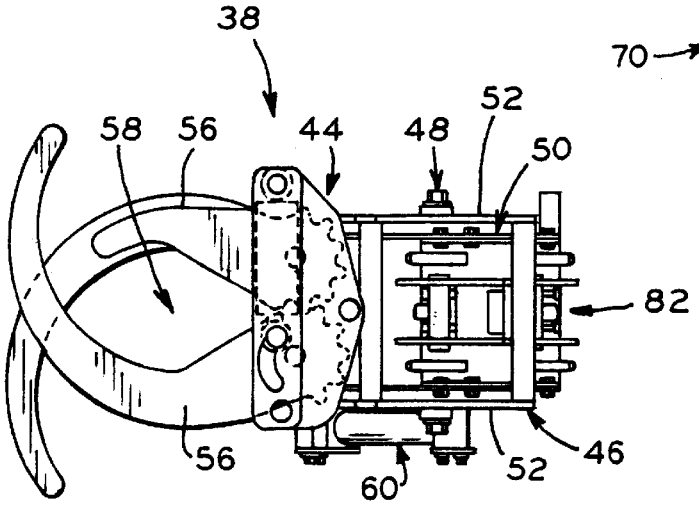
FIG. 5 is a top plan view of the pole guide assembly of FIG. 3.

FIGS. 3, 4, and 5 illustrate pole guide assembly 38 which includes gripper 44 used to grasp and stabilize telephone pole 22 as it is being installed in the ground (FIG. 2). Gripper 44 includes base portion 46 which is pivotally mounted to pole guide assembly frame 50 by bolt 48. Base 46 includes a pair of substantially L-shaped plates 52 mounted to each side of pole guide assembly frame 50 (FIG. 4). Affixed to end 54 of base 46 are substantially C-shaped arms 56 which overlap to define opening 58 in which telephone pole 22 is received when grasped (FIG. 5). Base 46 is pivoted by hydraulic cylinder 60 to raise and lower arms 56. Hydraulic cylinder 60 is attached at one end to gripper base 46 and at its opposite end to frame member 50.

Referring to FIG. 4, pole guide assembly frame 50 includes substantially rectangular opening 62 defined by substantially horizontal plate members 64 disposed between substantially vertical portions 66 defined by frame 50. Wear pads 68 are affixed to plate members 64 and vertical portions 66 by any suitable method, including fasteners. Opening 62 is sized to receive inner boom 32, thereby slidably mounting pole guide assembly 38 on boom 24. Disposed beneath opening 62 are flanged portions 70 which are spaced apart to define opening 72 therebetween. When pole guide assembly 38 is in its operative position (FIGS. 12 and 13), crane assembly 74 affixed to end 40 of inner boom section 32 is located between flanged portions 70 in opening 72. Crane assembly 74 includes rope 76 having hook 78 attached to the end thereof (FIGS. 1 and 2). Crane assembly 74 along with rope 76 allows digger derrick 20 to act as a crane, lifting and moving heavy equipment. When pole guide assembly 38 is in an operative position, guide rope 80 is wrapped around pole 22 and is attached to hook 78 (FIG. 1). Guide rope 80 helps stabilize and raise pole 22 to an upright position.

Figure 9:
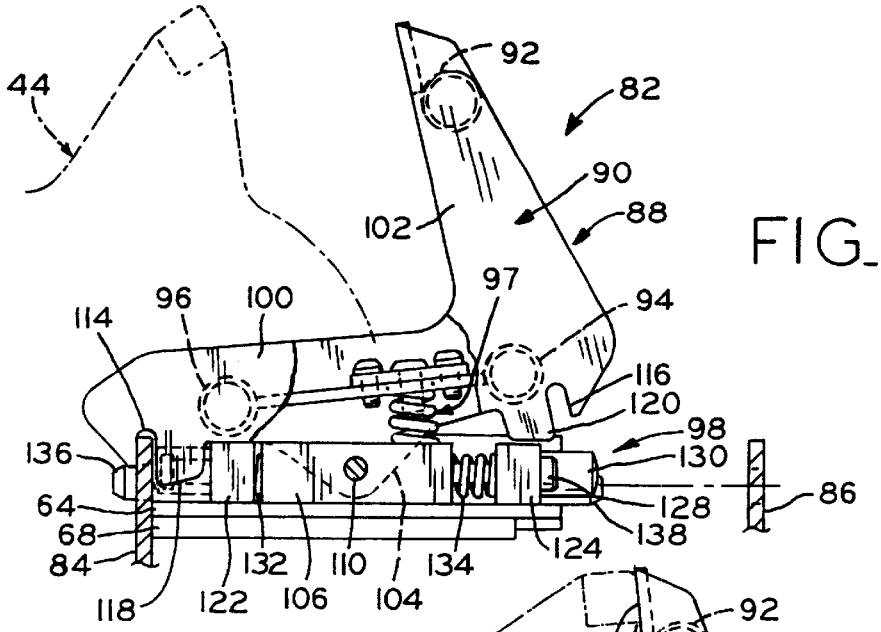
FIG. 9 is a side view of the latching mechanism of FIG. 8 taken along line 9—9 showing a first position.
Figure 15:
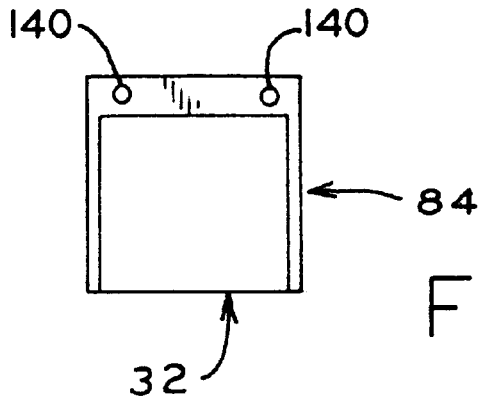
FIG. 15 is an end view of the outer boom section of the boom of FIG. 12 taken along line 15—15.
Figure 16:
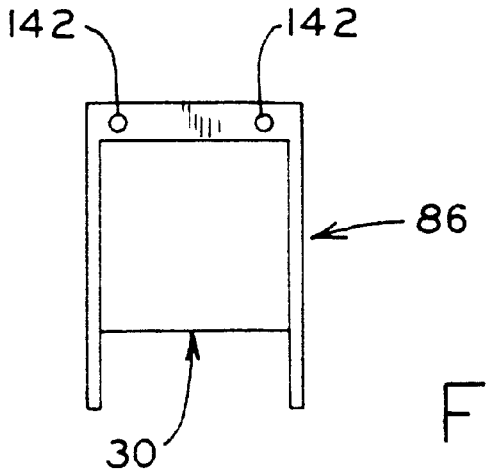
FIG. 16 is an end view of the middle boom section of the boom of FIG. 12 taken along line 16—16.
Figure 17:
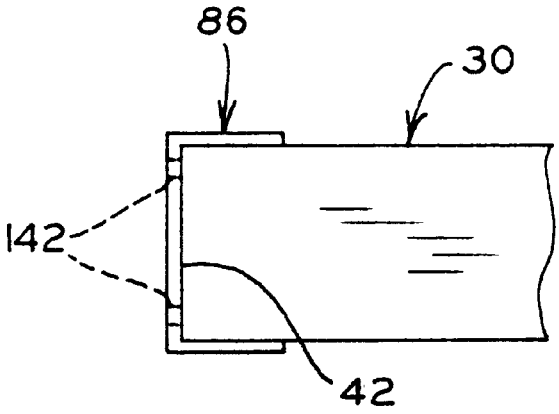
FIG. 17 is a top plan view of the middle boom section of FIG. 16.

Operatively attached to the upper substantially horizontal plate member 64 is latching mechanism 82 which secures pole guide assembly 38 respectively to boom sections 30 and 32. Referring to FIGS. 6–11, latching mechanism 82 is movable between first and second positions. The first position of latching mechanism 82 links pole guide assembly 38 to plate member 84 secured to end 40 of inner boom section 32 (FIG. 15), thus securing pole guide assembly 38 in its operative position (FIGS. 6 and 9). When pivoted rearwardly, latching mechanism 82 releases pole guide assembly 38 from its operative position and allows engagement of pole guide assembly 38 with U-shaped member 86 secured to end 42 of middle boom section 30 (FIGS. 16 and 17) to secure pole guide assembly 38 in its inoperative position. Further, plate member 84 and U-shaped member 86 are provided to actuate release mechanism 98 of latching mechanism 82 as will be discussed further hereinbelow.

Referring to FIGS. 6, 7, and 8, latching mechanism 82 includes latch arm 88 constructed from a pair of substantially L-shaped plates 90 (FIG. 7) which are secured to one another by crossbars 92, 94, and 96. Latch arm 88 is pivotally mounted to release mechanism 98 of latch mechanism 82 which will be described further hereinbelow. Latch arm 88 includes substantially horizontal leg 100 and substantially vertical leg 102. Substantially V-shaped projection 104 extends downwardly from horizontal leg 100. Plates 90 are assembled with stationary block 106 of release mechanism 98 such that projection 104 of each plate 90 is adjacent side 108 of block 106 (FIGS. 7 and 8). Arm 88 is pivotally mounted to stationary block 106 by bolt 110 which extends through projection 104 in each plate 90 and stationary block 106. Latch arm 88 includes plate 112 which extends between crossbars 94 and 96 in horizontal leg 100 (FIG. 6). Spring 97 is coupled to plate 112 and to release mechanism 98 to bias latch arm 88 into its first position wherein it engages plate member 84. Plate member 84 and U-shaped member 86 are shown in the figures as being in close proximity of one another for illustration purposes. Members 84 and 86 are only in close proximity of one another when boom sections 30 and 32 are retracted.

Referring to FIGS. 6, 9, 10, and 11, formed in the lower surface of each substantially horizontal leg 100 of latch arm 88, in both ends thereof, are notches 114 and 116. Each notch 114 and 116 is partially defined by projection 118 and 120, respectively, and receives plate member 84 and U-shaped member 86 to releasably couple pole guide assembly 38 in the operative and inoperative positions. Projections 118 and 120 act as stops to prevent premature movement of latch arm 88.

Referring to FIGS. 8, 9, 10, and 11, release mechanism 98 is operable to release latch arm 88 from one position engaging plate member 84 and allows arm 88 to pivot to a second position wherein arm 88 engages U-shaped member 86. Movable blocks 122 and 124 are located approximately parallel to edges 126 of stationary block 106 (FIG. 8). Bolts 128 are received in apertures located in movable blocks 122 and 124 and threadingly engage stationary block 106. Each movable block 122 and 124 includes a pin 130 which is in threaded engagement therewith and extends beyond the side of plate 64. Movable blocks 122 and 124 are biased away from stationary block 106 by springs 132 and 134. The ends of each spring 132 and 134 are fixed within stationary block 106 and respectively within movable blocks 122 and 124.

Mounted on each side of release mechanism 98 are aligning pins 136 and 138 disposed approximately parallel to bolts 128. Aligning pins 136 and 138 are mounted to plate 64 by any suitable method including welding. As illustrated in FIG. 8, each of members 84 and 86 is provided with apertures 140 and 142 which receive aligning pins 136 and 138, respectively, when pole guide assembly 38 is brought into contact with plate member 84 and U-shaped member 86 as will be discussed hereinbelow.

Figure 10:
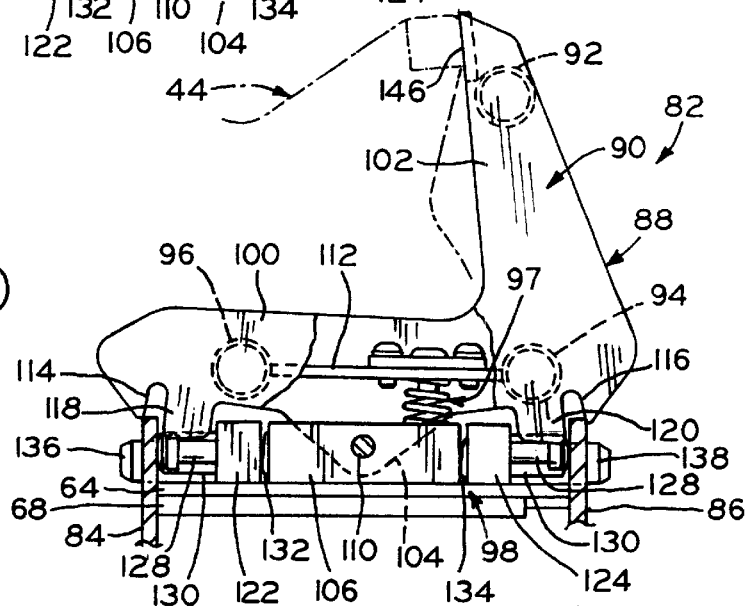
FIG. 10 is a side view of the latching mechanism of FIG. 8 similar to FIG. 9 but with the mechanism in an intermediate position.
Figure 11:
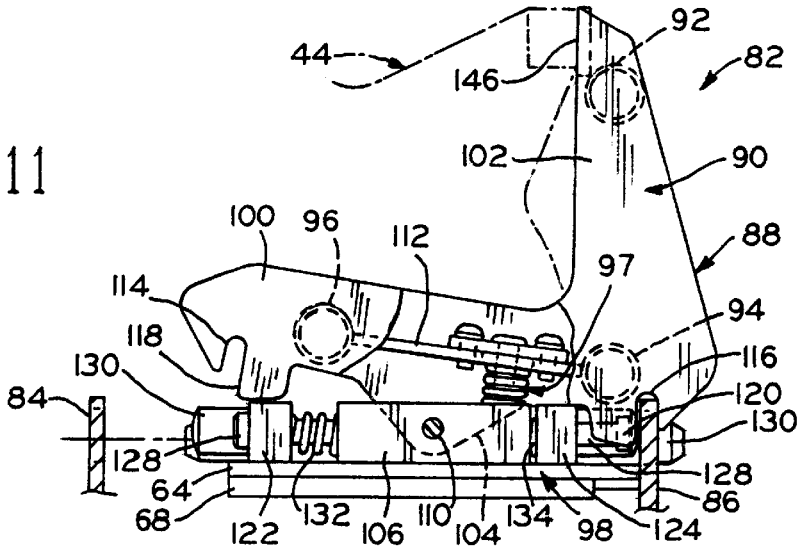
FIG. 11 is a side view of the latching mechanism of FIG. 8 similar to FIG. 9, but with the mechanism in a second position.

In operation, latching mechanism 82 allows pole guide assembly 38 to be selectively secured in a first, operative position (FIGS. 6, 8, 9, 12, and 13) and in a second, inoperative position (FIGS. 11 and 14). Latching mechanism 82 is movable only when inner boom section 32 is retracted within middle boom section 30. Referring to FIG. 10, when boom section 32 is completely retracted, alignment pins 136 and 138 respectively engage apertures 140 and 142 in plate member 84 and U-shaped member 86. Pins 130 contact both plate member 84 and U-shaped member 86 which compresses springs 132 and 134, forcing movable blocks 122 and 124 toward stationary block 106, and thereby permitting projections 118 and 120 to be released and latch arm 88 to be moved. Latch arm 88 is pivoted in one direction by the bias of spring 97 and by gripper 44 in the opposite direction. With blocks 122 and 124 moved inwardly, openings 144 are defined between bolts 128 and pin 136 on both sides of stationary block 106 and blocks 122 and 124.

With the boom sections retracted, latch arm 88 is free to pivot between first and second positions (FIGS. 9 and 11). Latch arm 88 is biased by spring 97 into its first position (FIG. 9) toward end 40 of inner boom 32 such that notch 114 is engaged by plate member 84 and projection 118 is received in opening 144. When latch arm 88 is in its first position, pole guide assembly 38 is coupled in its operative position to inner boom section 32 (FIGS. 6, 9, and 12). Inner boom section 32 is then extended out of middle boom section 30 such that movable block 124 is biased away from stationary block 106 by springs 134 (FIGS. 8 and 9). When movable block 124 is in this position, projection 120 contacts block 124 to prevent latch arm 88 from releasing plate member 84, and thus pole guide assembly 38.

Figure 13:
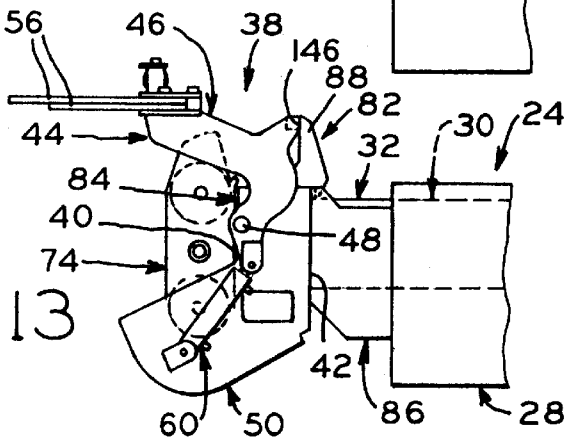
FIG. 13 is a side view of the retracted boom with the latching mechanism in an intermediate position.

In order to move pole guide assembly 38 from its operative position described above and to its inoperative position, latching mechanism 82 must first be released from being coupled to plate member 84. Inner boom section 32 having pole guide assembly 38 coupled thereto is again retracted within middle boom section 30. Alignment pins 136 and 138 respectively engage apertures 140 and 142 in plate member 84 and U-shaped member 86 (FIG. 10). Pins 130 contact both members 84 and 86. This contact forces movable blocks 122 and 124 to move along bolts 128 toward stationary block 106, compressing springs 132 and 134, and allowing latch arm 88 to be moved. Since latch arm 88 is biased by spring 97 into its first position, force must be applied to latch arm 88 to move it into its second position. Gripper 44 is used to supply this force and to overcome the biasing force of spring 97, thus pivoting latch arm 88 from its first position (FIG. 9) into its intermediate and second positions (FIGS. 10 and 11). Referring to FIGS. 12 and 13, gripper 44 is pivoted about bolt 48 by retracting hydraulic cylinder 60 to contact vertical leg 102 of latch arm 88 at 146 (FIGS. 10, 11, 13, and 14). The contact between gripper 44 and latch arm 88 pivots latch arm 88 about bolt 110. From the intermediate position shown in FIG. 10, latch arm 88 is pivoted further by gripper 44 into its second position, thus coupling pole guide assembly 38 in its inoperative position with middle boom section 30 (FIG. 11).

In the second position, notch 116 is engaged by U-shaped member 86 and projection 120 is received in opening 144 defined between bolts 128 and pin 136 associated with movable block 124. With latch arm 88 in its second position, notch 114 is no longer engaged by plate member 84 and pole guide assembly 38 is coupled to middle boom section 30 in its inoperative position (FIG. 14). Once latch arm 88 is pivoted into its second position, inner boom section 32 is extended away from middle boom section 30. With pole guide assembly 38 in its inoperative position, inner boom section 32 may be extended away from middle boom section 30 and digger derrick truck 20 may be used as a crane without interference of pole guide assembly 38 with crane assembly 74 (FIG. 14). Referring to FIG. 11, pin 130 secured to movable block 122 is then no longer in contact with plate member 84. Movable block 122 is biased by springs 132 away from stationary block 106 and into a position wherein it is located underneath projection 118 of latch arm 88. With block 122 in this position, pivotal movement of latch arm 88 out of its second position is prevented by contact between projection 118 and block 122. Release of pole guide assembly 38 from its inoperative position is also prevented.

In order to move pole guide assembly 38 back into its operative position, boom section 32 is retracted within boom section 30 so that pins 136 and 138 respectively engage apertures 140 and 142 in plate member 84 and U-shaped member 86. Pins 130 contact members 84 and 86, moving blocks 122 and 124 inwardly along bolts 128 toward stationary block 106 to create openings 144 between bolts 128 and pins 136. Grippers 44 are lowered by hydraulic cylinder 60 to no longer be in contact with latch arm 88. Spring 97 biases latch arm 88 into its first position such that notch 114 is engaged by plate member 84. Inner boom section is extended away from middle boom section 30 to allow movable block 124 to be biased away from stationary block 106 by springs 134. Block 124 is then in position underneath projection 120 to prevent latch arm 88 from pivoting out of its first position.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A digger derrick apparatus, comprising:

a boom;

a pole guide member movably mounted on said boom, said pole guide member having a plurality of boom positions;

a latch operatively associated with said pole guide member, said latch having a first latch position wherein said latch releasably locks said pole guide member in one of said boom positions, and a second latch position wherein said latch releasably locks said pole guide member in another one of said boom positions; and a release member operatively associated with said latch, said release member operable to selectively cause said latch to operate in a selected one of said first and second latch positions.

2. The apparatus of claim 1 wherein said latch is pivotable and said release member pivots said latch between said first latch position and said second latch position.

3. The apparatus of claim 1 wherein said boom comprises a plurality of telescoping boom sections.

4. The apparatus of claim 3 wherein said pole guide member is movably mounted on one of said boom sections.

5. The apparatus of claim 4 wherein said boom has an innermost boom section and wherein said pole guide member is mounted on said innermost boom section.

6. The apparatus of claim 1 wherein said pole guide member comprises a gripper.

7. The apparatus of claim 6 wherein said release member is secured to said gripper.

8. The apparatus of claim 7 wherein said gripper is pivotable.

9. The apparatus of claim 1 wherein said latch comprises a pivotable latch arm, said latch arm having a first latch position and a second latch position, whereby when said latch arm is in said first latch position said pole guide member is locked in an operative position to said boom and when said latch arm is in said second latch position said pole guide member is locked in an inoperative position to said boom.

10. The apparatus of claim 8 including a spring, said spring biasing said latch arm into said first latch position.

11. The apparatus of claim 9 wherein said boom must be retracted to release said pole guide member from said inoperative position.

12. The apparatus of claim 11 wherein said release member is actuated by the retraction of said boom.

13. A digger derrick apparatus comprising:

a boom having a plurality of telescoping boom sections including an innermost boom section;

a pole guide member movably mounted on said boom, said pole guide member having a plurality of boom positions including an operative boom position and an inoperative boom position;

a latch operatively associated with said pole guide member, said latch having a pivotable latch arm, said latch arm having a first latch position wherein said latch arm releasably locks said pole guide member in one of said boom positions, and a second latch position wherein said latch arm releasably locks said pole guide member in another one of said boom positions; and a release member operatively associated with said latch arm, said release member selectively operable to cause said latch to latch said pole guide member in one of said operable and inoperable boom positions.

14. The apparatus of claim 13 wherein said latch is pivotable and said release member pivots said latch arm between said first latch position and said second latch position.

15. The apparatus of claim 13 including a spring, said spring biasing said latch arm into said first latch position.

16. The apparatus of claim 13 wherein said pole guide member is mounted on the innermost boom section.

17. The apparatus of claim 16 wherein said pole guide member is movably mounted on one of said boom sections.

18. The apparatus of claim 13 wherein said pole guide member comprises a gripper.

19. The apparatus of claim 18 wherein said gripper is pivotable.

20. The apparatus of claim 18 wherein said release member is secured to said gripper.

21. The apparatus of claim 20 wherein said release member is actuable only when said boom is retracted.

* * * * *